United States Patent [19]

Smith

[11] Patent Number: 5,058,274

[45] Date of Patent: Oct. 22, 1991

[54] SHAPING AND SCRAPING TOOL

[76] Inventor: Neville J. Smith, 164B Calle Aralar, Las Fuentes, Alcoceber, Alcala de Chivert, Castellon, Spain

[21] Appl. No.: 591,434

[22] Filed: Oct. 1, 1990

[30] Foreign Application Priority Data

Oct. 27, 1989 [GB] United Kingdom ..... 8924239

[51] Int. Cl.[5] ..... B26B 29/00; B26B 5/00; B26B 3/04

[52] U.S. Cl. ..... 30/169; 30/280; 30/299; 30/264

[58] Field of Search ..... 30/280, 169, 289, 172, 30/293, 294, 299, 314

[56] References Cited

U.S. PATENT DOCUMENTS

| | | | |
|---|---|---|---|
| 1,584,021 | 5/1926 | Dunn | 30/299 |
| 2,655,721 | 10/1953 | Einhorn | 30/299 |
| 2,681,506 | 6/1954 | Tipple | 30/299 |
| 2,814,870 | 12/1957 | Treiber | 30/299 |
| 4,021,912 | 5/1977 | Stanfield | 30/280 |
| 4,358,893 | 11/1982 | Stanfield | 30/280 |

*Primary Examiner*—Douglas D. Watts
*Assistant Examiner*—Paul M. Heyrana
*Attorney, Agent, or Firm*—Edwin D. Schindler

[57] ABSTRACT

A shaping and/or scraping tool comprises a main body with a handle means adjacent one end and at the other end a carrier portion for a large plurality of cutting blades individually slidable and lockable towards and away from the handle means in said carrier portion so that the ends of the blades define a cutting edge of chosen shape.

8 Claims, 1 Drawing Sheet

SHAPING AND SCRAPING TOOL

FIELD OF THE INVENTION

This invention relates to a hand-held shaping and/or scraping tool.

BACKGROUND TO THE INVENTION

Hand-held shaping and/or scraping tools are common for shaving or cleaning down flat surfaces, and for this purpose are provided with a straight cutting edge.

An object of this invention is to provide an improved hand-held shaping and/or scraping tool which is more versatile than conventional scrapers commonly in use.

SUMMARY OF THE INVENTION

According to the invention, there is provided a shaping and/or scraping tool having a main body which provides or supports a handle at or adjacent one end and has a portion at the other end which is formed as a carrier for a large plurality of cutting elements disposed in abutting parallel relationship and which project from the main body away from the handle, said elements together defining a cutting edge at their free ends and being individually and selectively movable in the carrier towards and away from the handle to enable said cutting edge to be conformed to a chosen shape, and means for locking the cutting elements to the carrier each in its selected position of adjustment.

The cutting elements preferably comprise parallel-faced cutting blades abutting face to face.

The thickness of the blades is sufficiently small, for example of the order of 1 mm, to enable cutting edges to be obtainable of smoothly curved shapes.

The width of the blades is preferably sufficient, for example greater than 0.5 cm up to about 1.5 cm, that two cutting edges are defined at their free ends, respectively at the front and rear corners of said free ends. In conjunction with this, a laterally projecting handle member on the main body may be reversible to project from either one side of the main body. Moreover, the blades may be so formed as to present a reversely directed cutting edge at the back, whereby the tool can be used with either a push or a pull action.

In an embodiment, about 70 blades are provided in a tool of the order of 7 cm wide.

A blade mounting means preferably comprises a lock rod extending from side to side of the carrier through elongate apertures in the blades. A pivotted locking lever on the rod may be rotatable between blade-locking and blade-unlocking positions, for example acting on the carrier to cause the blades to be pressed and squeezed into friction-locking relationship with one another in the blade locking position. Alternatively, the lock rod, which is preferably of square cross-section, may be caused by the locking lever to bear tightly against the blades to effect friction locking. The lock rod is preferably removable to permit blade replacement. Said lock rod may also serve to hold in position a guide positioned adjacent one end of the cutting edge or edges, release of the locking lever also enabling the guide to be adjusted in position towards or away from the handle.

DESCRIPTION OF EMBODIMENT

An embodiment of hand-held shaping and scraping tool in accordance with the invention will now be exemplified with reference to the accompanying drawings, in which.

Figure 1:
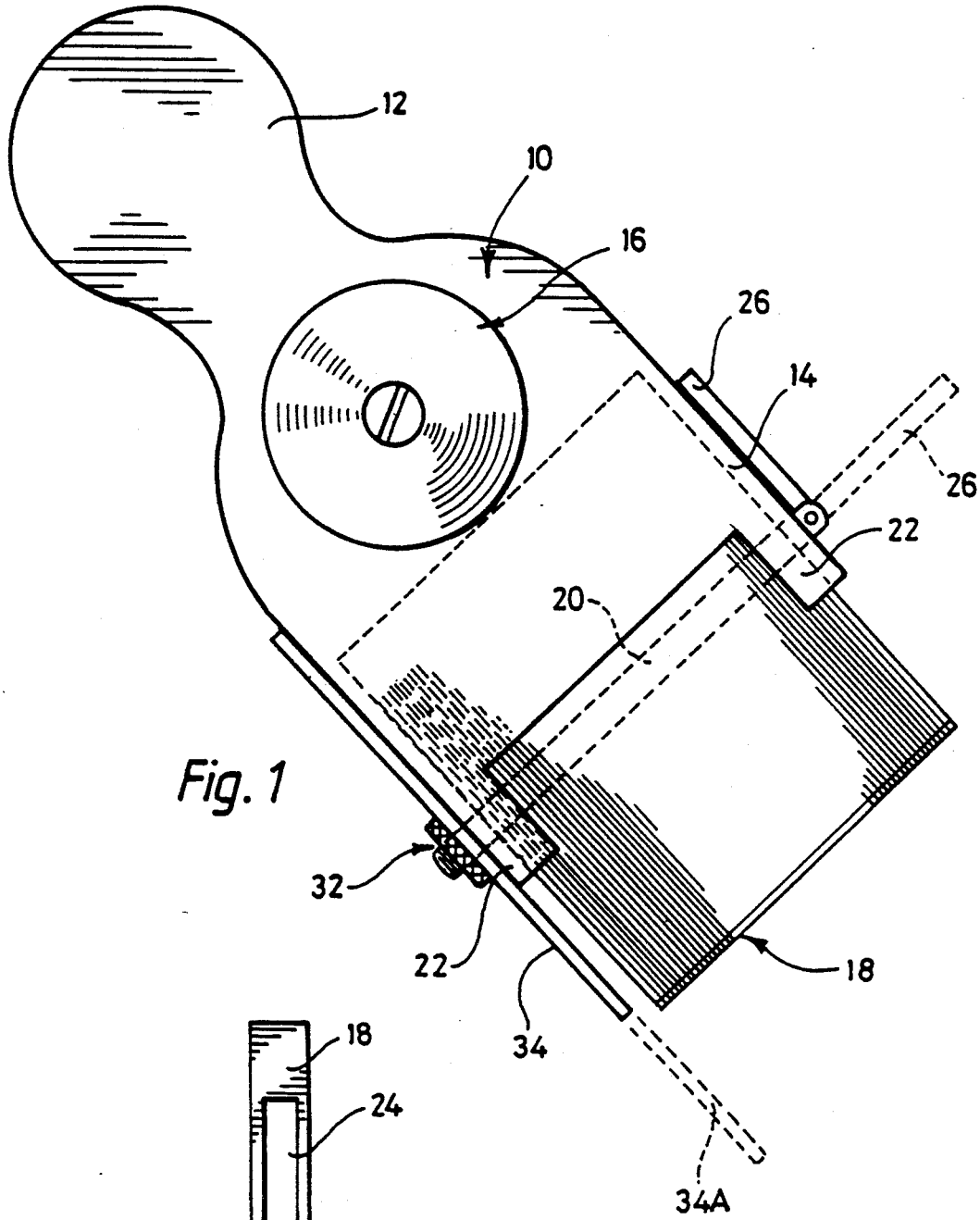
FIG. 1 shows the tool from the front.

Referring to the drawings, the tool comprises a main body 10 with a shaped handle portion 12 at one end and a forked carrier 14 at the other end. Adjacent the handle portion 12, a knob-shaped handle member 16 is selectively fixable to project laterally from either side of the main body 10.

In the exemplified embodiment, the carrier is about 7 cm wide and holds 70 cutting blades 18 each of the order of 1 mm thickness. The cutting blades 18 are parallel sided, and lie in parallel relationship abutting flat face to flat face. A square-sectioned lock rod 20 holds the cutting blades 18 in the carrier, the said lock rod extending between the arms 22 of the forked carrier and passing through elongate apertures 24 in the blades (see FIG. 2). A locking lever 26 is pivotally mounted at one end of the lock rod. When the lever 26 is turned to bear against the exterior of the carrier, as shown in full line in FIG. 1, the lock rod is pulled outwardly, causing the arms of the forked carrier to be pressed towards one another, thereby squeezing the cutting blades into friction-locking relationship. However, when the locking lever 26 is released to the position shown in broken line in FIG. 1, the pull on the lock rod 20 is relaxed, and the cutting blades can individually and selectively slide relative to one another, towards and away from the handle.

Figure 2:
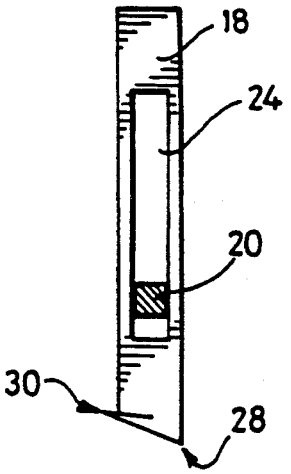
FIG. 2 shows detail of a cutting blade.

The blades are conveniently of the order of 1 cm wide, so as at their free ends to define cutting edges 28 and 30 at their front and rear corners (see FIG. 2). When the locking lever is released, the blades can be adjusted in position so that the two cutting edges conform to a chosen shape, such as the profile of a door or window frame. As the blades are of such small thickness, the shape can be defined very accurately, and include smoothly rounded portions. A convenient method of adjusting the blades may be to press the ends of the blades against a surface to be scraped, with the locking lever released. However, the blades can alternatively be pushed by hand to conform to a profile represented by a drawing, for example.

It is to be noted that the cutting edge 30 is reversely directed, so that in conjunction with the reversibility of the handle member 16, the tool can be used with either a push or a pull action.

On the side of the carrier opposite to the locking lever 26, the lock rod 20 is secured by a bolt head/nut arrangement 32 which serves as an abutment for that end of the lock rod when the locking lever is operated. The nut can be unscrewed to enable withdrawal of the lock rod and locking lever (the latter first being released), thereby to enable blade replacement.

Additionally, the bolt head/nut arrangement 32 serves to hold in position a guide member 34 for one side of the cutting tool. When the locking lever is released, the guide member can be displaced towards or away from the handle, and locked in a selected position of adjustment simultaneously with locking the blades. The dotted line 34A in FIG. 1 shows a position of adjustment of the guide member 34 in which it will act as a guide running against the side of a profile being shaved or scraped.

It will be appreciated that the above-described embodiment may be modified in a variety of ways within the scope of the invention hereinbefore defined.

What is claimed is:

1. A shaping and/or scraping tool comprising:

a main body;

a handle adjacent one end of said main body;

a carrier forming part of said main body at an end remote from said handle, said carrier including two spaced parallel arms projecting away from said handle;

a large plurality of cutting elements carried by said carrier in an abutting parallel relationship between said spaced arms, said cutting elements projecting from said main body away from said handle beyond ends of said spaced arms of said carrier and said cutting elements being individually and selectively adjustable in said carrier towards and away from said handle together to define a cutting edge of chosen shape at their free ends; and, means for locking said cutting elements in said carrier, each in its selected position of adjustment, said means for locking comprising:

a mounting rod extending between said spaced arms of said carrier through elongate apertures in said cutting elements when said means for locking is released; and, means cooperating with said mounting rod for urging together said two spaced parallel arms of said carrier for pressing and squeezing said cutting elements into a friction-locking relationship with one another for locking said cutting elements in the selected position of adjustment.

2. A tool according to claim 1, wherein said means cooperating with said mounting rod is a pivoted locking lever on said mounting rod, said locking lever being rotatable between blade-locking and blade-unlocking positions.

3. A tool according to claim 2, wherein the mounting rod serves to hold in position a guide positioned adjacent one end of the cutting edge or edges, release of the locking lever enabling the guide to be adjusted in position towards or away from the handle.

4. A tool according to claim 1, wherein the cutting elements comprise parallel-faced cutting blades abutting face to face.

5. A tool according to claim 4, wherein the thickness of the blades is sufficiently small to enable cutting edges to be obtainable of smoothly curved shapes.

6. A tool according to claim 5, wherein two cutting edges are defined at the free ends of the blades, respectively at the front and rear corners of said free ends.

7. A tool according to claim 6, wherein the blades are so formed as to present a reversely directed cutting edge at the back, whereby the tool can be used with either a push or a pull action.

8. A tool according to claim 1, wherein the mounting rod is removable to permit blade replacement.

* * * * *